United States Patent [19]

Hershberger

[11] 4,377,725

[45] Mar. 22, 1983

[54] ASYNCHRONOUS MULTICHANNEL RECEIVER

[75] Inventor: David L. Hershberger, Quincy, Ill.

[73] Assignee: Harris Corporation, Cleveland, Ohio

[21] Appl. No.: 138,846

[22] Filed: Apr. 10, 1980

Related U.S. Application Data

[63] Continuation of Ser. No. 934,811, Aug. 18, 1978, abandoned.

[51] Int. Cl.[3] ..... H04H 5/00

[52] U.S. Cl. ..... 179/1 GS; 329/135

[58] Field of Search ..... 179/1 GS; 329/135, 167

[56] References Cited

U.S. PATENT DOCUMENTS

| | | | |
|---|---|---|---|
| 3,068,475 | 12/1962 | Avins | 179/1 GS |
| 3,089,096 | 5/1963 | Moore | 179/1 GS |
| 3,218,393 | 11/1965 | Kahn | 179/1 GS |
| 4,079,204 | 3/1978 | Takahashi et al. | 179/1 GS |
| 4,172,966 | 10/1979 | Parker et al. | 329/135 |
| 4,184,046 | 1/1980 | Parker | 179/1 GS |
| 4,185,171 | 1/1980 | Parker | 179/1 GS |

*Primary Examiner*—Douglas W. Olms
*Attorney, Agent, or Firm*—Yount & Tarolli

[57] ABSTRACT

A receiver (12) including an asynchronous demodulator (28) for recovering program signals from a composite modulated signal (46) including in-phase (48) and quadrature-phase (50) components. A phase detector (52) provides a signal corresponding to the phase of the composite modulated signal, while an envelope detector (54) provides a signal corresponding to the envelope of the composite modulated signal. The quadrature-phase component is demodulated by multiplying the phase and envelope signals together in an analog multiplier (56). In one embodiment, this demodulated signal is distortion-corrected by combining it with a distortion correction signal. Circuitry (66, 68, 69) is also provided for using the envelope and phase signals to asynchronously demodulate the in-phase component of the composite modulated signal. A signal processing circuit (70) recovers the program signals from the in-phase and quadrature-phase modulating signals.

12 Claims, 6 Drawing Figures

$$V_e = \sqrt{[1+(L+R)\cos\theta]^2 + [(L-R)\sin\theta]^2}$$

$$\phi = \tan^{-1}\left[\frac{(L-R)\sin\theta}{1+(L+R)\cos\theta}\right]$$

ASYNCHRONOUS MULTICHANNEL RECEIVER

This is a continuation of application Ser. No. 934,811, filed Aug. 18, 1978, now abandoned.

CROSS REFERENCE TO RELATED APPLICATIONS

Related co-pending, commonly assigned patent applications include Leitch "Compatible AM Stereo System Employing a Modified Quadrature Modulation Scheme," Ser. No. 019,837, filed Mar. 12, 1979, continuation of Ser. No. 812,657, filed July 5, 1977, now abandoned; and Leitch "AM Stereo Receivers," Ser. No. 829,518, filed Aug. 31, 1977.

BACKGROUND OF THE INVENTION

The present invention relates to the art of receiver systems for receiving and demodulating modulated signals, and more particularly to an asynchronous system for recovering the signals modulating the in-phase, and quadrature-phase components of a modulated signal.

Many systems have been proposed for transmitting and receiving stereophonic signals in the AM frequency band. Several of these schemes have proposed modulating the two program signals onto differently phased carriers and then linearly combining them to form the composite stereo signal which is to be transmitted. If the phase angle between the two carrier signals is set at approximately 90°, the system represents a standard quadrature modulating system. Other systems have been proposed, however, wherein the phase angle between the two carriers is reduced to be less than 90°. A system of this latter sort is disclosed in the co-pending application of Leitch, U.S. Ser. No. 812,657, filed July 5, 1977.

Synchronous detection schemes have generally been employed to demodulate signals which have been modulated in this fashion. Synchronous detectors include circuitry (usually a voltage controlled oscillator) for providing a reference phase signal, as well as a phase-locked-loop to maintain the phase of the reference signal in a specific phase relationship with the carrier component of the incoming signal. The inclusion of this circuitry, of course, adds to the cost and complexity of the receiver system.

SUMMARY OF THE INVENTION

It would be desirable to provide an asynchronous system for receiving these signals, i.e. one which did not require a phase reference signal. The phase reference circuitry could then be eliminated, thus simplifying the circuit, reducing its cost, and improving its reliability.

It is therefore an object of the present invention to provide an asynchronous receiver for demodulating the in-phase and quadrature-phase components of a modulated signal.

It is an additional object of the present invention to provide a receiver which does not require phase reference circuitry and which is thus lower cost, simpler, and of greater reliability than previous receivers.

It is a more specific object of the present invention to provide an asynchronous receiver which demodulates the quadrature phase component of a modulated signal by multiplying a phase signal, representative of the changing phase of the modulated signal, by an envelope signal representative of the changing amplitude of the modulated signal.

It is an additional object of the present invention to provide a system for utilizing the quadrature-phase modulating signal thus recovered to provide asynchronous detection of the in-phase modulating signal.

In accordance with the present invention, apparatus is provided for use in a system for receiving a modulated signal having a modulated in-phase component and a modulated quadrature-phase component. The apparatus is operative to demodulate the quadrature-phase component, and comprises means for detecting the envelope of the modulated signal to provide an envelope signal, means for detecting the phase of the modulated signal in order to provide a phase signal, and means for multiplying the envelope signal by the phase signal in order to provide a product signal which generally corresponds to the signal modulated upon the quadrature-phase component.

In accordance with another aspect of the present invention, means are provided for recovering a second signal corresponding generally to the signal modulating the in-phase component of the modulated signal. This means comprises means for multiplying the recovered quadrature-phase modulating signal by the phase signal so as to derive a third signal, and means for subtracting a signal proportional to the third signal from a signal proportional to the envelope signal so as to thereby provide the signal which corresponds essentially to the signal modulating the in-phase component of the modulated signal.

BRIEF DESCRIPTION OF THE DRAWINGS

The foregoing and other objects and advantages of the present invention will become more readily apparent from the following description of a preferred embodiment, as taken in conjunction with the accompanying drawings, wherein.

DETAILED DESCRIPTION

Figure 1:
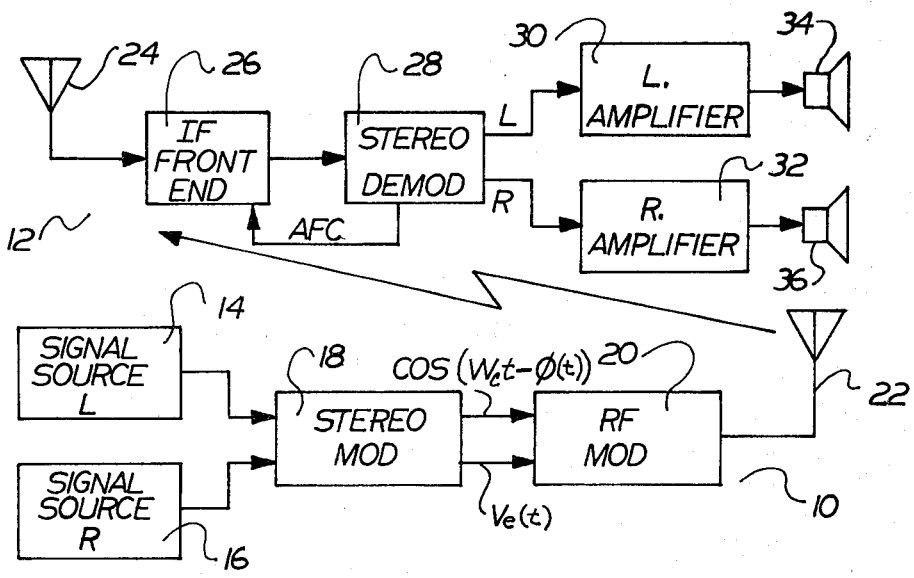
FIG. 1 is a broad block diagram of a system wherein the demodulating apparatus of the present invention may conveniently find use.

FIG. 1 illustrates a stereo system wherein a demodulator in accordance with the teachings of the present invention might conveniently find use. In this system, a transmitter 10 generates and then transmits a composite modulated signal to a receiver 12. The transmitter 10 includes two signal sources 14 and 15, each of which generates a corresponding program signal. In the example presently being described, these program signals are stereophonically related. Thus, in accordance with accepted nomenclature, these program signals will hereinafter be referred to as left (L) and right (R) source signals. These program signals are provided to a stereo modulator 18 which modulates one or more carrier signals therewith to form a composite modulated RF signal. In order to transmit this signal with a conventional AM transmitter, the composite modulated RF signal is then separated into an amplitude portion defining the envelope of the composite modulated signal, and a phase portion comprising an RF signal whose amplitude is fixed, but whose phase varies in accordance with the phase of the composite modulated signal. RF modulator 20, which may be a conventional AM transmitter, amplifies and recombines the phase and amplitude portions of the signal in order to once again generate the composite modulated signal, and then transmits this high level signal via an antenna 22.

In the receiver 12, another antenna 24 receives the composite modulated signal, and provides it to an IF front-end 26. IF front-end 26, which will generally include a frequency convertor and an IF strip, converts the incoming RF signal to an IF frequency. A stereo demodulator 28, which is the subject of the present application, separates out the left and right source signals from the IF signal, and then supplies them separately to amplifiers 30 and 32. In the Figure, the separated source signals are shown as driving speakers 34 and 36. The stereo demodulator 28 may also provide an automatic frequency control (AFC) signal to the frequency converter of the IF front-end 26 in order to provide closed-loop control of the IF frequency.

Figure 2A:
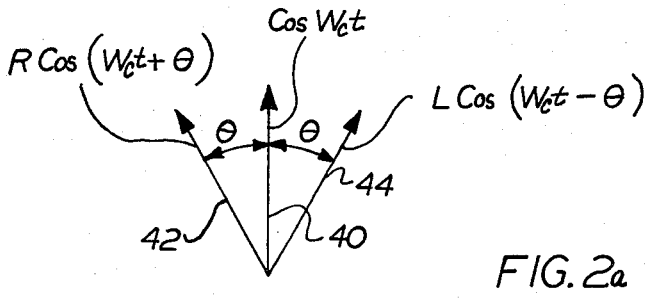
FIGS. 2*a*–2*c* are vector diagrams representing the relationship between the various phase components of the composite modulated signal.
Figure 2B:
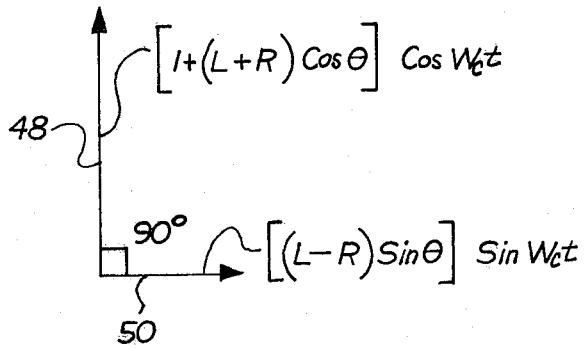
Figure 2C:
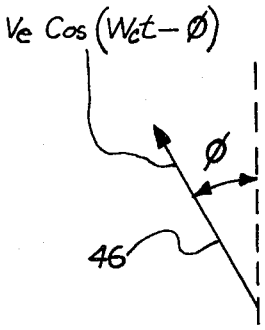

The nature of the signals which are generated by stereo modulator 18, and which must be demodulated by stereo demodulator 28, is represented vectorially in FIG. 2. As can be seen in FIG. 2*a*, the composite modulated signal may be characterized as essentially a linear combination of three differently phased components. These components include a fixed carrier component 40 and two modulated phase components 42 and 44. The phase components are derived by double-sideband, suppressed carrier (DSB-SC) modulating carrier components which are phased at equal and opposite angles on either side of the carrier component. The composite modulated signal is derived by linearly combining these three components, and may be characterized at any instant in time as comprising a single vector having a particular amplitude, and at a particular phase with respect to the phase of the carrier component (see FIG. 2*c*). Both the phase and amplitude of this composite signal will vary in time.

The modulated signal may equivalently be characterized as a linear combination of two quadrature-phased components (see FIG. 2*b*): an amplitude modulated component 48 which is in-phase with the carrier signal, and a DSB-SC modulated signal 50 which is in phase-quadrature with the carrier signal.

All three of the vector diagrams in FIG. 2 represent the same composite modulated signal, and can be mathematically shown to be equivalent.

If the angle $\theta$ (FIG. 2*a*) is equal to 45°, then the two modulated phase components 42 and 44 of the composite modulated signal are phased apart by 90°. In this case the composite modulated signal represents a conventional quadrature modulated signal. As was described in the above-mentioned Leitch patent application, however, it is desirable in AM stereo applications to reduce this phase angle below 45°, in order to be compatible with existing monophonic AM receivers. In these applications, a phase angle of approximately 15° has been found to be optimum.

In order to derive stereophonic information from this signal, it has conventionally been the practice to either synchronously demodulate the in-phase and quadrature-phase components, and then matrix the resulting signals together in order to derive the two source signals, or to synchronously demodulate the two phase components of the composite modulated signal directly.

It has now been found, however, that the composite modulated signal may be demodulated asynchronously. More specifically, it has been found that the quadrature-phase component of the composite modulator signal may be demodulated asynchronously by multiplying the amplitude portion of the signal by the phase portion of the signal.

Thus, the envelope portion of the signal may be mathematically defined as:

$$V_e = \sqrt{(1 + V_1)^2 + V_2^2} \tag{1}$$

Where:

$$V_1 = (L+R)\cos\theta \tag{2}$$

$$V_2 = (L-R)\sin\theta \tag{3}$$

Using a series expansion to expand this mathematical expression:

$$V_e = (1+V_1) + V_2^2/[2(1+V_1)] - V_2^4/[8(1+V_1)^3] + V_2^6/[16(1+V_1)^5]\ldots \tag{4}$$

Similarly, the phase function may be mathematically defined as:

$$\phi = \mathrm{Tan}^{-1}[V_2/(1+V_1)] \tag{5}$$

which may be similarly expanded using a series expansion to get:

$$\phi = V_2/(1+V_1) - [V_2/(1+V_1)]^3/3 + [V_2/(1+V_1)]^5/5 \ldots \tag{6}$$

If we multiply the phase function by the envelope function, we thus get:

$$\phi V_e = V_2 + V_2^3/[(6(1+V_1)^2] - 11V_2^5/[120(1+V_1)^4]\ldots \tag{7}$$

Since the second and third terms of this series add very little to the sum, the product of the phase and envelope functions represents a very good approximation to $V_2$. From equation 3 it will be remembered, however, that $V_2$ essentially represents the difference, or (L−R) signal, weighted by a factor of Sin $\theta$. This is the quadrature-phase modulating function.

Figure 3:
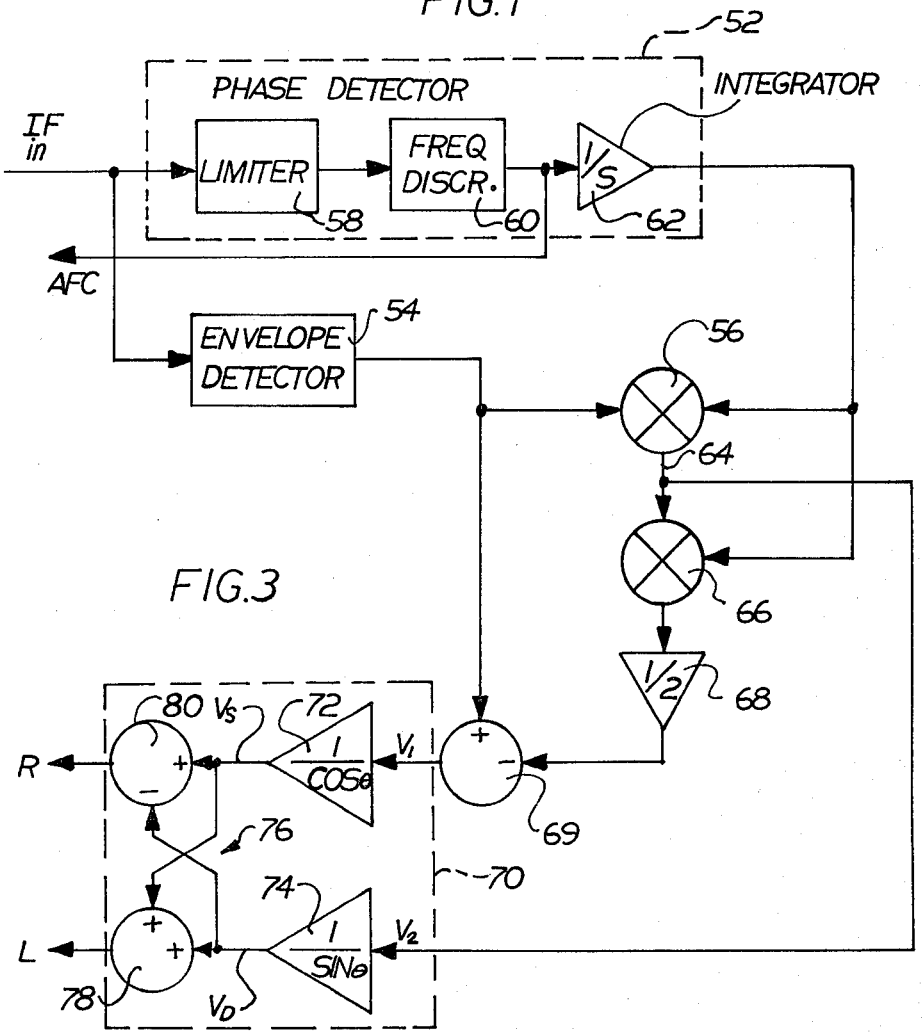
FIG. 3 is a block diagram of a stereo demodulator in accordance with the teachings of the present invention.

FIG. 3 illustrates a stereo demodulator 28 which implements this concept in order to demodulate the quadrature-phase component of the modulated signal. This circuitry, of course, processes the IF signal rather than directly processing the received RF signal. The IF signal is, however, essentially identical to the composite modulated signal, except that the frequency of the signal has been converted to a lower, intermediate frequency. Therefore, the demodulation process which must be implemented is the same as outlined above.

The circuitry of FIG. 3 which demodulates the quadrature-phase component includes a phase detector 52, an envelope detector 54, and an analog multiplier 56. Any conventional phase and envelope detectors may be used to provide the necessary phase and envelope detection of the IF signal. In FIG. 3, however, the phase detector is more specifically shown as including a limiter 58, a frequency discriminator 60, and an integrator circuit 62. The limiter 58 is provided in order to amplitude limit the signal presented to the frequency discriminator, and will only be necessary when a frequency discriminator 60 is utilized which is amplitude sensitive.

The output of frequency discriminator 60 comprises an analog signal whose amplitude will vary in accordance with the frequency of the IF signal. The output signal is used in FIG. 3 as the AFC signal which controls the IF frequency. This closed loop control of the IF frequency insures that the DC value of the output of frequency discriminator 60 will remain at a predetermined reference level, usually ground level. The phase modulation of the composite modulated signal will introduce deviations on either side of this reference level. Since frequency represents essentially the time derivative of phase, a phase signal may be derived simply by integrating this frequency signal with respect to the reference level. It is for this purpose that integrator 62 is included. The output of integrator 62 will therefore comprise an audio frequency signal whose amplitude varies in accordance with the phase of the IF signal. The envelope detector 54 may take any convenient form, and will provide an audio frequency signal whose amplitude varies in accordance with the envelope of the IF signal.

The phase and amplitude signals are supplied to a conventional analog multiplier circuit 56, which multiplies them together to provide a product signal at its output 64. As stated previously, this output signal represents a close approximation of the signal modulating the quadrature-phase component of the incoming IF signal, and thus of the composite modulated signal.

The demodulator must also operate to recover the signal modulating the in-phase component of the composite modulated signal. In the event that the phase angle between the phase components 42 and 44 (FIG. 2*a*) of the composite modulated signal is small enough, the envelope of the IF signal (defined by equation 1, above) represents a fair approximation of $(1+V_1)$, which is the signal modulating the in-phase component of the composite modulated signal. Thus, where the angle between the two modulated phase components of the composite modulated signal is approximately 30° (i.e. where $\theta$ of FIG. 2*a* is equal to 15°), the output of the envelope detector 54 may be directly utilized as the in-phase component of the modulated signal.

In situations wherein the phase angle between the two components is larger, however, the direct use of the output of the envelope detector will lead to an unacceptable level of distortion. In this event, some more exact method must be provided for demodulating the in-phase component of the composite modulated signal. This is again accomplished asynchronously in the demodulating apparatus illustrated in FIG. 3.

Mathematically, the functioning of this portion of the demodulator may be described as follows. The output of analog multiplier 56 represents the product of the phase and envelope functions, and is described by equation 7, above. By multiplying this output signal by the phase signal once again, a signal having the following form results:

$$\phi^2 V_e = V_2^2/(1+V_1) - V_2^4/[6(1+V_1)^3] + 19V_2^6/[360(1+V_1)^5] + \ldots \quad (8)$$

By scaling this by a factor of $\frac{1}{2}$, and subtracting it from the output of the envelope detector 54 (described by equation 1) a signal is provided which may be defined as:

$$V_e - \phi^2 V_3/2 = (1+V_1) - V_2^4/[24(1+V_1)^3] + 13V_2^6/[360(1+V_1)^5] + \ldots \quad (9)$$

It will be noted that the $V_2^2$ term present in the envelope function has been cancelled, leading to a significant reduction in the amount of the distortion. The signal defined by equation 9 therefore approximates the signal $(1+V_1)$ much more closely than does the envelope signal. From equation 2, however, it will be remembered that this signal represents the signal modulating the in-phase component of the composite modulated signal, and corresponds to the sum (L+R) signal, weighted by a factor of Cos $\theta$.

In the stereo demodulator illustrated in FIG. 3, this operation is provided by a second analog multiplier 66, which multiplies the output of analog multiplier 56 by the phase function, in conjunction with attenuator 68 and signal subtractor circuit 69. The attenuator circuit 68 scales the relative amplitudes of the output of the envelope detector 54 and the output of the analog multiplier 66 so that when combined by signal subtractor 69, the resulting signal will have the $V_2^2$ term substantially cancelled. Signal subtractor circuit 69 subtracts the output of attenuator circuit 62 from the output of the envelope detector 54 to provide the signal having the form defined by equation 9, above.

The output of signal subtractor 69, representing the weighted sum of the L and R source signals, as well as the output of analog multiplier 56, which represents the weighted difference of the L and R source signals, are both directed to a processing circuit 70 which reconstructs the L and R signals therefrom. The output of signal subtractor 69 will be AC coupled into signal processor 70 in order to remove the DC term represented by the "1" in the $(1+V_1)$ term of equation 9. The signals input into processor 70 therefore represent close approximations of $V_1$ and $V_2$, as defined by equations 2 and 3, above.

It will be noted that these signals correspond to the sum (L+R) and difference (L−R) of the two program signals, weighted by factors of Cos $\theta$ and Sin $\theta$, respectively. When the phase angle $\theta$ is equal to 45°, the amplitudes of the two signals will be equivalently weighted. For all other phase angles, however, it will be necessary to include gain circuits, such as circuits 72 and 74, to correct for the unequal weighting introduced by the sine and cosine terms of equations 2 and 3. As can be seen in FIG. 3, gain circuit 72 provides a gain factor of 1/Cos $\theta$, whereas gain circuit 74 provides a gain factor of 1/Sin $\theta$. The output of gain circuits 72 and 74 therefore comprise the amplitude equalized sum (L+R) and difference (L−R) signals. The source signals may be derived from these signals simply by directing them through a standard audio matrix indicated at 76. A signal summer 78 adds the two signals in order to derive the left source signal (L), and a signal subtractor 80 subtracts the two signals from one another in order to derive the right source signal (R). The source signals may be then directed to any desired utilization circuit.

Figure 4:
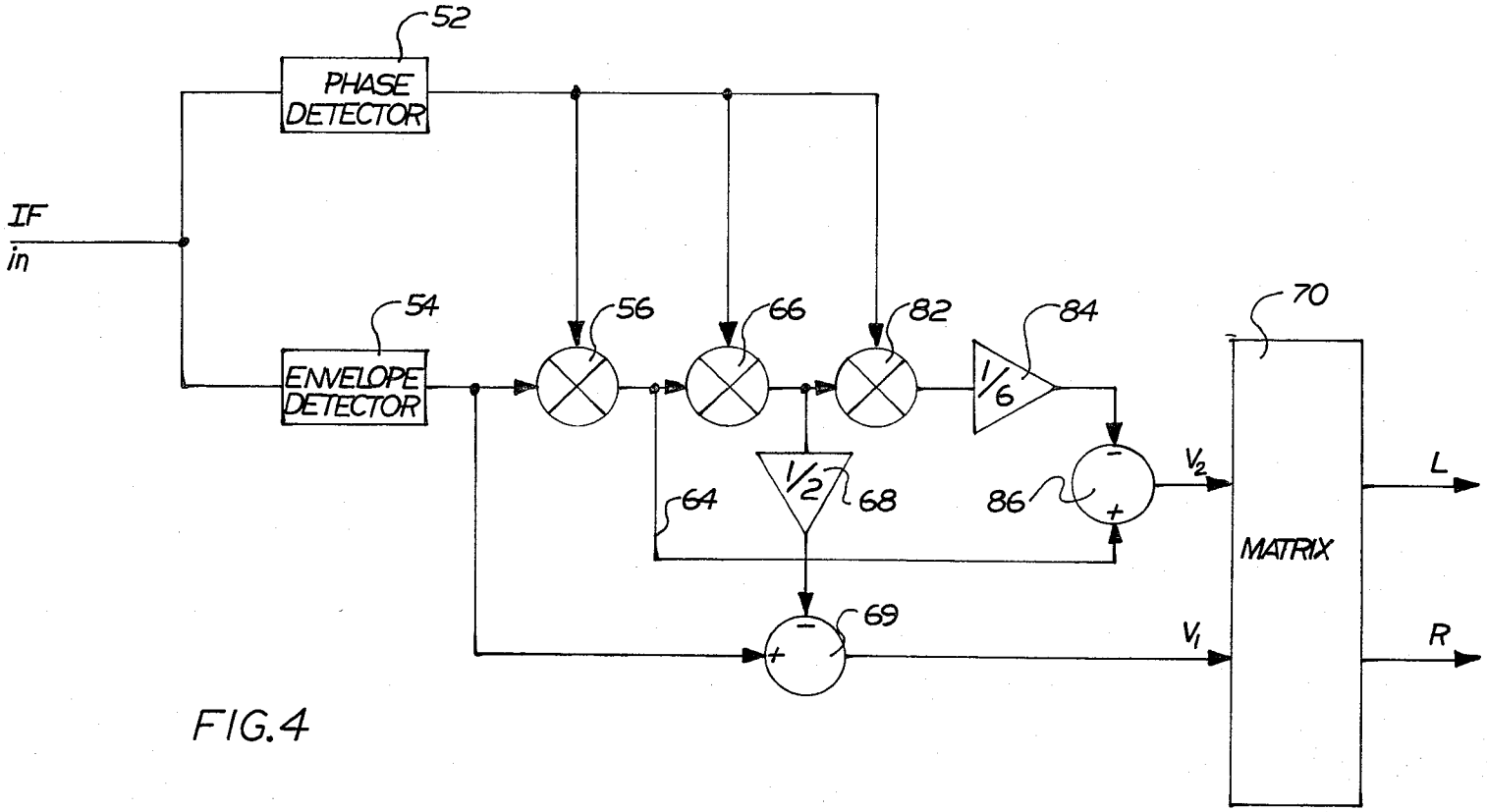
FIG. 4 is a block diagram of another embodiment of a stereo demodulator in accordance with the teachings of the present invention.

FIG. 4 illustrates another embodiment of a stereo demodulator in accordance with the present invention. This embodiment is similar to the FIG. 3 embodiment, except that the recovered quadrature-phase modulating signal undergoes further processing in order to reduce the contributions of the distortion terms. For simplicity of description, elements of FIG. 4 which correspond to similar elements of FIG. 3 are identified by similar reference numbers.

This demodulator of FIG. 4 includes all of the elements of FIG. 4, and further includes an additional analog multiplier 82, a signal attenuator circuit 84, and a signal subtractor 86. Analog multiplier 82 and signal attenuator 84 are connected so as to generate a signal which, when combined with the recovered quadrature-phase modulating signal by signal subtractor 86, will cancel much of the distortion therein.

Analog multiplier 82 multiplies the output of multiplier 66 (equation 8) by the phase signal (equation 6) recovered by phase detector 52. The resulting product signal has the form:

$$\phi^3 V_e = V_2^3/(1+V_1)^2 - V_2^5/[2(1+V_1)^4] + 37V_2^7/[120(1+V_1)^6]\ldots \quad (10)$$

This signal is attenuated by a factor of six by signal attenuator 84, and is then subtracted from the output of analog multiplier 56 (equation 7). The output of signal subtractor 86 therefore is:

$$\phi V_e - \phi^3 V_3/6 = V_2 - V_2^5[120(1+V_1)^4] + 5V_2^7[504(1+V_1)^6]\ldots \quad (11)$$

This represents a closer approximation to $V_2$ than the output of multiplier 56, since the second term of equation 7 has been cancelled and the third term greatly reduced. In this embodiment, then, it is the output of signal subtractor 86 which serves as the recovered quadrature-phase modulating signal, and which is provided to matrix circuit 70 in place of the output of multiplier 56.

It will be appreciated that the stereo demodulator which has been described will be particularly useful in demodulating the two source signals from a composite modulated signal when the source signals have been modulated on differently phased carriers which were then linearly added to provide the composite modulated signal. The invention, however, has much broader application and may be used to asynchronously demodulate the in-phase and quadrature-phase components of any modulated signal, whatever its form.

Also, although the invention has been described with respect to a preferred embodiment, it is not intended to limit the invention to this embodiment. Many alterations are, of course, possible. For example, although the demodulator has been described as demodulating an IF signal, the invention could as easily be used to directly demodulate the RF signal, without first converting to an intermediate frequency. Furthermore, the inclusion of various refinements is also contemplated, such as circuitry for detecting a stereo pilot signal, means for switching between stereo and mono modes, etc.

Therefore, although the invention has been described with respect to a preferred embodiment, it will be appreciated that any number of changes may be made without departing from the spirit and scope of the present invention, as defined in the appended claims.

What is claimed is:

1. Apparatus for use in a system for receiving a modulated signal having a modulated in-phase component and a modulated quadrature-phase component, said apparatus being operative to demodulate said quadrature-phase component, comprising:

means for detecting the envelope of said modulated signal to provide an envelope signal;

means for detecting the phase of said modulated signal to provide a phase signal;

means for multiplying said envelope signal by said phase signal so as to provide a product signal;

means responsive to said phase and envelope signals for generating a distortion correction signal which varies generally with the difference between said product signal and the signal modulated upon said quadrature-phase component; and means for combining said product signal and said distortion correction signal so as to derive a distortion corrected product signal corresponding generally to said signal modulated upon said quadrature-phase component.

2. Apparatus for recovering the signals modulated onto first and second common frequency, differently phased components of a modulated signal comprising:

means for detecting the envelope of said modulated signal to provide an envelope signal;

means for detecting the phase of said modulated signal to provide a phase signal;

means for multiplying said envelope signal by said phase signal so as to provide a first signal corresponding generally to the signal modulating the quadrature-phase component of said modulated signal;

means for providing a second signal corresponding generally to the signal modulating the in-phase component of said modulated signal, comprising means for multiplying said first signal by said phase signal so as to derive a third signal and means for subtracting a signal proportional to said third signal from a signal proportional to said envelope signal so as to thereby provide said second signal corresponding generally to the signal modulating said in-phase component of said modulated signal; and means responsive to said first and second signals for processing said signals so as to derive therefrom said signals modulated onto said first and second components.

3. Apparatus as set forth in claim 2, wherein said modulated signal includes a carrier component and wherein said first and second components are phase displaced at substantially equal phase angles on either side of said carrier component, said first and second components each being modulated by a corresponding source signal, and further wherein said processing means comprises means for adjusting the relative amplitudes of said first and second signals as a function of said phase angle, and means for adding said amplitude adjusted signals to one another in order to derive one of said source signals and for subtracting said amplitude adjusted signals from one another in order to derive the other said source signal.

4. Apparatus as set forth in claim 2, and further comprising means for reducing distortion in said first signal to provide a distortion corrected first signal, and for providing said distortion corrected first signal to said processing means in place of said first signal.

5. Apparatus as set forth in claim 2, and further comprising means for multiplying said third signal by said phase signal so as to provide a fourth signal, and means for subtracting a signal proportional to said fourth signal from a signal porportional to said first signal so as to thereby provide a distortion corrected first signal, and for providing said distortion corrected first signal to said processing means in place of said first signal.

6. An asynchronous receiver for receiving and demodulating a modulated RF signal which includes a carrier component and first and second phase components phased at substantially equal phase angles on either side of said carrier component, said phase components each being modulated in accordance with a corresponding one of first and second source signals, comprising:

means for receiving said modulated RF signals;

IF amplifier means for converting said received signals into a corresponding IF signal;

envelope detector means for detecting the envelope of said IF signal to provide an envelope signal having an amplitude which varies with said envelope;

phase detector means for detecting the phase of said IF signal to provide a phase signal having an amplitude which varies with said phase;

means for multiplying said envelope signal by said phase signal so as to provide a difference signal generally corresponding to the difference between said first and second source signals, weighted by a factor dependent upon the phase angle between said phase components and said carrier component;

means for multiplying said difference signal by said phase signal so as to provide a second product signal;

means for subtracting a signal proportional to said second product signal from a signal proportional to said envelope signal so as to provide a sum signal generally corresponding to the sum of said first and second source signals, weighted by a factor dependent upon said phase angle;

means for adjusting the relative amplitudes of said sum and difference signals as a function of said phase angle;

means for adding said amplitude adjusted signals to one another in order to derive one of said source signals, and for subtracting said amplitude adjusted signals from one another in order to derive the other of said source signals; and means for utilizing said first and second source signals as thus recovered.

7. Apparatus for use in a system for receiving a modulated signal having a modulated in-phase component and a modulated quadrature-phase component, said apparatus being operative to demodulate said quadrature-phase component, comprising:

means for detecting the envelope of said modulated signal to provide an envelope signal;

means for detecting the phase of said modulated signal to provide a phase signal;

means for combining said envelope signal with said phase signal so as to provide a first combined signal;

means responsive to said phase and envelope signals for generating a distortion correction signal which varies generally with the difference between said first combined signal and the signal modulated upon said quadrature-phase component; and means for combining said first combined signal and said distortion correction signal so as to derive a distortion corrected signal corresponding to said signal modulated upon said quadrature-phase component.

8. Apparatus for use in a system for receiving a modulated signal having a modulated in-phase component and a modulated quadrature-phase component, said apparatus being operative to demodulate said in-phase component, comprising:

means for detecting the envelope of said modulated signal to provide an envelope signal;

means for detecting the phase of said modulated signal to provide a phase signal;

means responsive to said envelope signal and said phase signal for providing a signal generally corresponding to the product of said envelope signal and the square of said phase signal; and means for proportionally subtracting said product signal from said envelope signal to provide a signal generally corresponding to the signal modulated upon said in-phase component.

9. Apparatus as set forth in claim 1, wherein said means for providing said distortion correction signal comprises means for providing a distortion correction signal which is substantially proportional to the product of said envelope signal and a power of said phase signal.

10. Apparatus as set forth in claim 1, wherein said means for providing said distortion correction signal comprises means for providing a distortion correction signal which is substantially proportional to the product of said envelope signal and the cube of said phase signal.

11. Apparatus for use in a system for receiving a modulated signal having a modulated in-phase component and a modulated quadrature-phase component, said apparatus being operative to demodulate said in-phase component, comprising:

means for detecting the envelope of said modulated signal to provide an envelope signal;

means for detecting the phase of said modulated signal to provide a phase signal;

means responsive to said envelope signal and said phase signal for providing a distortion correction signal which varies generally with the difference between said envelope signal and the signal modulated upon said in-phase component; and means for proportionally subtracting said distortion correction signal from said envelope signal to provide a signal generally corresponding to the signal modulated upon said in-phase component.

12. Apparatus as set forth in claim 11, wherein said means for providing said distortion correction signal comprises means for providing a distortion correction signal corresponding generally to the product of said envelope signal and a power of said phase signal.

* * * * *